United States Patent [19]

Wirth

[11] 3,946,516

[45] Mar. 30, 1976

[54] MODULAR MARBLE GAME

[76] Inventor: Peter Wirth, Bachtelstrasse 18, 8340 Hinwil, Switzerland

[22] Filed: Dec. 24, 1974

[21] Appl. No.: 536,238

[30] Foreign Application Priority Data

Dec. 27, 1973 Switzerland ..... 18267/73

[52] U.S. Cl. ..... 46/17; 46/43

[51] Int. Cl.[2] ..... A63H 33/06

[58] Field of Search .. 46/17, 43; 173/118 R, 118 A, 173/120, 129

[56] References Cited

UNITED STATES PATENTS

| | | | |
|---|---|---|---|
| 1,714,433 | 5/1929 | Molnar | 46/43 |
| 2,397,794 | 4/1946 | Lee | 46/43 |
| 3,496,669 | 2/1970 | Siggelow | 46/43 |

*Primary Examiner*—Louis G. Mancene
*Assistant Examiner*—Robert F. Cutting
*Attorney, Agent, or Firm*—Murray Robinson; Ned L. Conley; Arthur M. Dula

[57] ABSTRACT

Apparatus for use in the modular construction of games to be played with marbles comprising a plurality of each of two members. The second member is channel shaped and adapted to contain and direct the rolling movement of small spheres, such as marbles, under the influence of gravity. The first member is a hollow supporting structure of cylindrical or regular polygonol cross section, each said first member having one small end and one large end whereby a plurality of said first members may be securely mounted one on top of the other. Said first member is provided with openings in its surface adapted to receive an end of a said second channel shaped member. Many different games played with marbles can be constructed by connecting a plurality of said first and said second members in varying configurations.

5 Claims, 7 Drawing Figures

MODULAR MARBLE GAME

BACKGROUND OF THE INVENTION

1. Field of the Invention

The present invention relates to apparatus used for playing games, and more particularly it relates to a first modular member and a second modular member that may be connected in a plurality of configurations to create apparatus for playing games with marbles.

2. Description of the Prior Art

Apparatus used for playing games with marbles is well-known to the prior art. Some examples illustrating the prior art in this field are Swiss Pat. No. 388,165 and German Pat. Nos. 481,724 and 494,671.

The prior art discloses a channel shaped member for guiding marbles and various means of coupling the guiding means together. The prior art also teaches varying the slope of the guiding means by placing supporting means at differing heights or by placing the guiding means over make-shift supports such as books, furniture or the like.

Games that are played with marbles are most popular with children between the ages of 3 and 8 years of age. The apparatus used for playing with marbles disclosed in the prior art is usually too complex for the average child to assemble. This is due to the fact that there are too many different parts to the building blocks that require assembly and that the connections between each individual block or member is too complex for the child of that age to master. Thus a child who wishes to use the apparatus disclosed in the prior art must call for the help of adults or older children.

SUMMARY OF THE INVENTION

According to the present invention the apparatus for playing games with marbles is assembled from a plurality of two different modular members. The second modular member is a channel-shaped member used to guide the marble as it rolls under the influence of gravity. The first said modular member is a hollow cylindrical or polygonal member having unequal diameter ends whereby a plurality of the said first members may be stacked vertically and also having lateral openings adapted to receive an end of said second modular member.

It is an object of the present invention to provide a modular apparatus for playing games with marbles that may be assembled by a child of from 3 to 8 years of age without assistance.

DESCRIPTION OF THE PREFERRED EMBODIMENT

Figure 1:
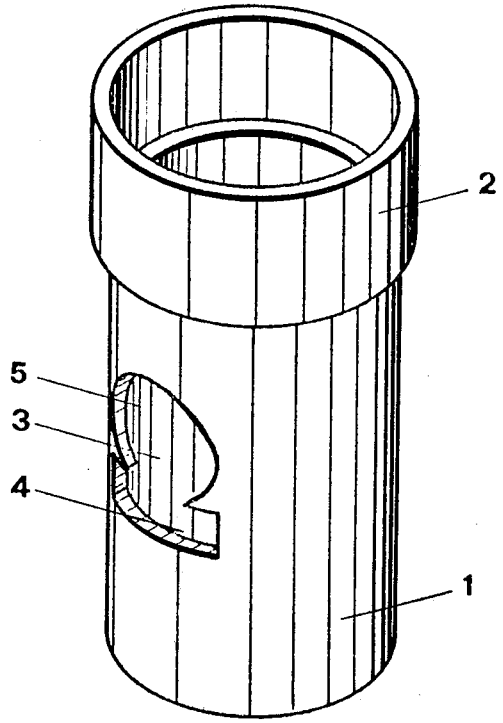
FIG. 1 is an isometic view of a first modular member as taught by the preferred embodiment of this invention viewed from the front.

FIG. 1 illustrates a modular first support member that is substantially a cylindrical section. This first member has a lower end 1 whose outer diameter is such that it approximates the inner diameter of the upper end 2 of said first member. This first member may be of any convenient polygonal cross-section or may be circular as shown. In each case the inner diameter of the upper part 2 and the outer diameter of the lower part 1 must be dimensioned so that two similar modular members will fit together tightly if one is put on top of the other. There is a lateral opening 3 on the lower part 1 of this first modular member. Said lateral opening comprises a rectangular portion 4 and a circular portion 5 and is adapted to securingly receive an end of a second modular member, which is a channel-shaped guiding member, as is discussed below.

Alternatively, this first supporting and coupling modular member may be constructed with its larger end on the lower end of the member and its smaller end on the upper end of the member without departing from the spirit of the invention.

Figure 2:
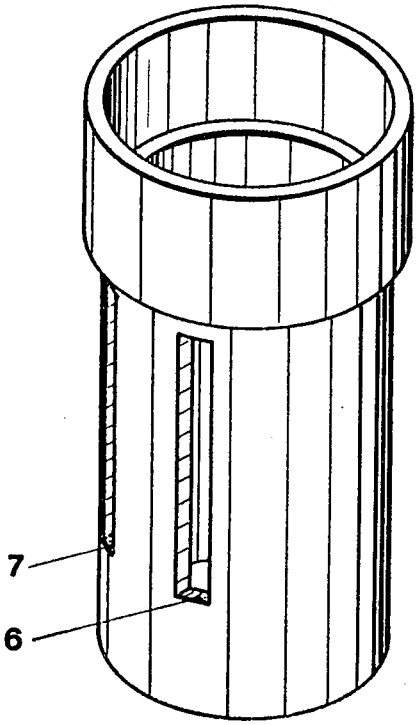
FIG. 2 is an isometric view of the same first member as was shown in FIG. 1, but seen from the rear.

FIG. 2 illustrates the same first modular member as was shown in FIG. 1, but viewed from the rear. On the lower part 1 of the modular member there are two vertically aligned slots 6 and 7 which are arranged so as to receive the ends of the second modular member to be described below. Slots 6 and 7 are arranged in such a manner that the vertical plane of symmetry of these slots coincides with the vertical plane of symmetry passing through the center of opening 3 when said plane of symmetry also includes the vertical axis of rotation of said first modular member.

Figure 3:
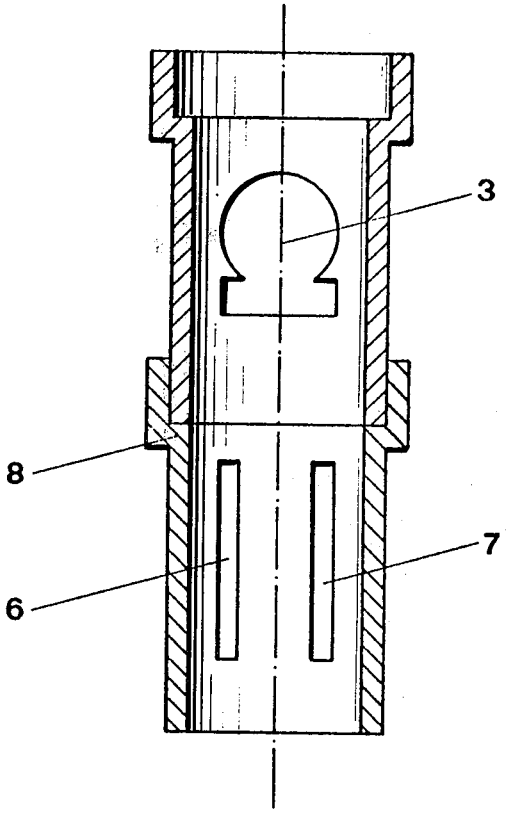
FIG. 3 is a reduced sectional view of two first modular members mounted one atop the other with the upper first modular member turned 180° with respect to the lower first modular member.

FIG. 3 is a reduced sectional view of two first modular members according to FIG. 1 or FIG. 2 placed one on top of the other. The lower member is rotated 180° with respect to the upper member. FIG. 3 clearly illustrates that opening 3 and slots 6 and 7 are symmetrically placed as described above. A shoulder 8 on the lower modular member retains and seats the lower end of the upper modular member. Said shoulder prevents the vertical movement of the upper modular member but does not confine its rotation, therefor any rotational alignment of the two members is possible.

Figure 4:
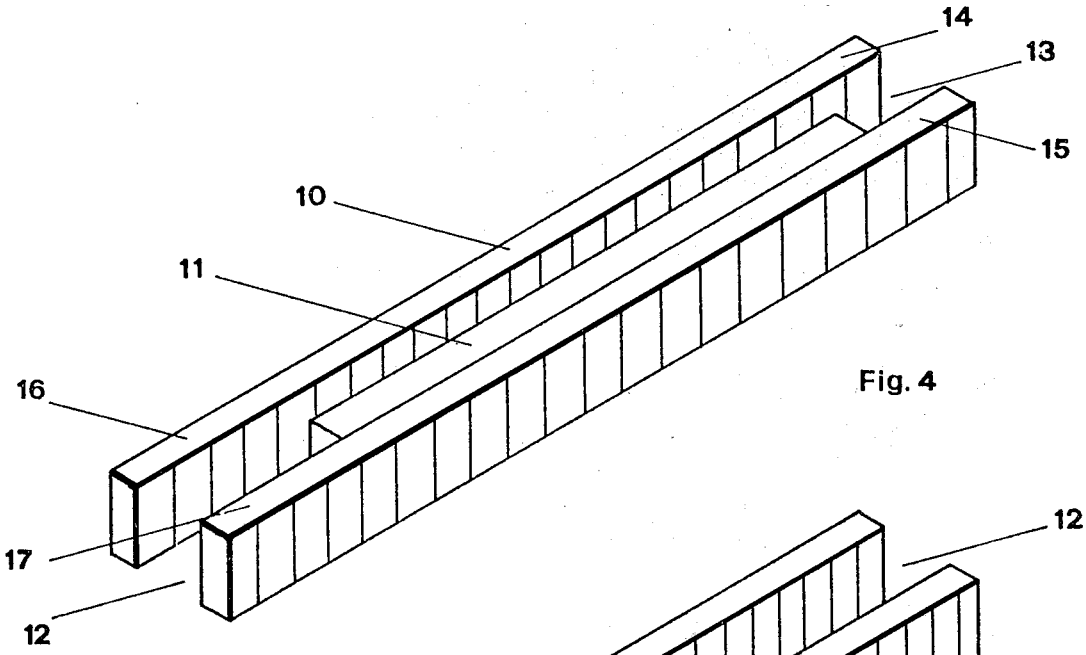
FIG. 4 is an isometric view of a species of second modular member as taught by the preferred embodiment of the present invention.

FIG. 4 illustrates a second modular member used in the preferred embodiment of the invention. This second modular member is essentially a U-shaped channel. In the embodiment shown it comprises a rectangular rod 10 having a groove 11 that does not extend the entire length of the rod. Because groove 11 does not extend the entire length of rod 10, recesses 12 and 13 are formed at the ends of said rod. In the embodiment illustrated by FIG. 4, recess 12 is deeper than recess 13, the difference in depth being about the size of a marble's diameter.

The portion of rectangular rod 10 that is not coextensive with groove 11 defines a pair of prongs at each end of the rod. Prongs 16 and 17 define recess 12 and prongs 14 and 15 define recess 13 respectively in FIG. 4. All of these prongs are equal in width and heighth. Further, the prongs are adapted so they will securely fit into slots 6 and 7 shown in FIG. 2 and FIG. 3. The width of rod 10 corresponds to the width of the rectangular portion 4 of opening 3 illustrated in FIG. 2. Thus, the second modular member is adapted to fit into the rectangular portion 4 of opening 3 as shown in the first modular member according to FIG. 1 and FIG. 3 and the prongs of the second modular member securely engage slots 6 and 7 illustrated in FIGS. 1 and 3. If the end of rod 10 having the deeper recess 12, and thus the longer prongs 16 and 17, engages a first modular member through its opening 3, there is formed by recess 12 a substantially vertical opening about the size of a marble, whereby a marble rolling down the channel-shaped second modular member will fall vertically when it enters the connected first modular member.

Figure 5:
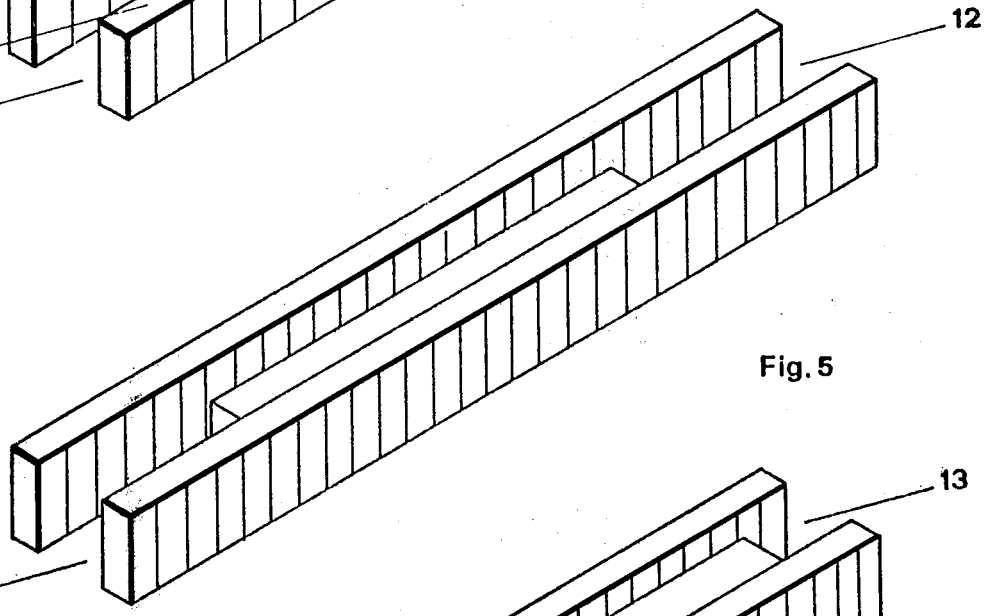
FIG. 5 is an isometric view of another species of said second modular member.

FIG. 5 shown another embodiment of the second modular member. It is substantially similar to the embodiment illustrated in FIG. 4, but differs from that embodiment in that its recesses 12 and 13 are of equal depth. When connected to a first modular member as described above the embodiment illustrated in FIG. 5 causes a marble rolling to either end of the channel-shaped member to fall vertically when it enters a connected first modular member.

Figure 6:
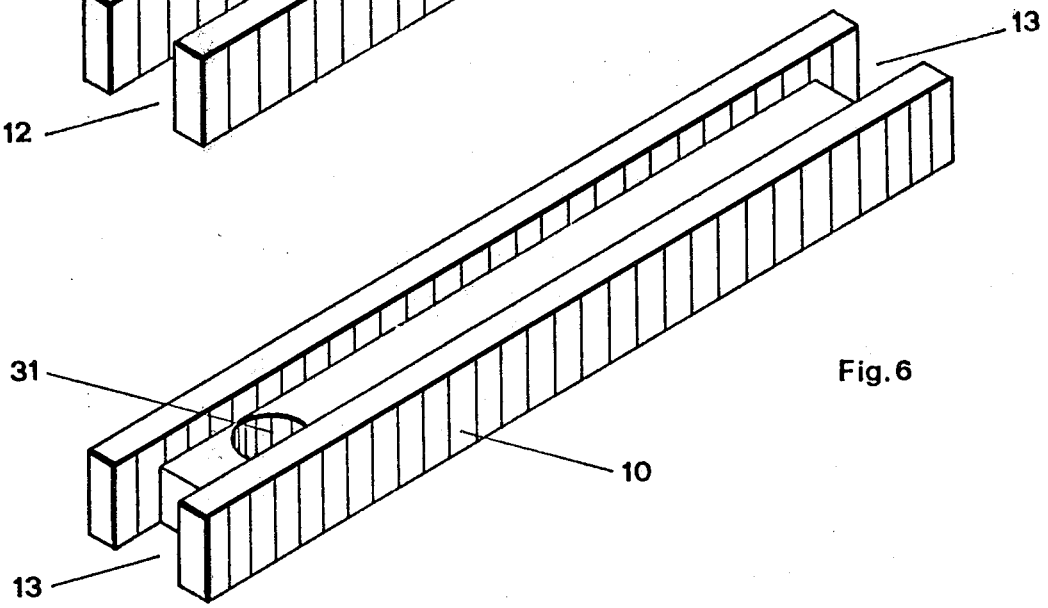
FIG. 6 is an isometric view of yet a further species of said second modular member.

FIG. 6 illustrates yet a further embodiment of the second modular member. This embodiment is substantially similar to the embodiments illustrated in FIGS. 4 and 5, but bears two equal recesses at its terminal ends similar to recess 13 in FIG. 4. Additionally, there is an opening 31 at one end of rod 10, said opening having its axis perpendicular to that of the rod. This opening is at least the size of a marble and is positioned such that a marble may pass through it.

Figure 7:
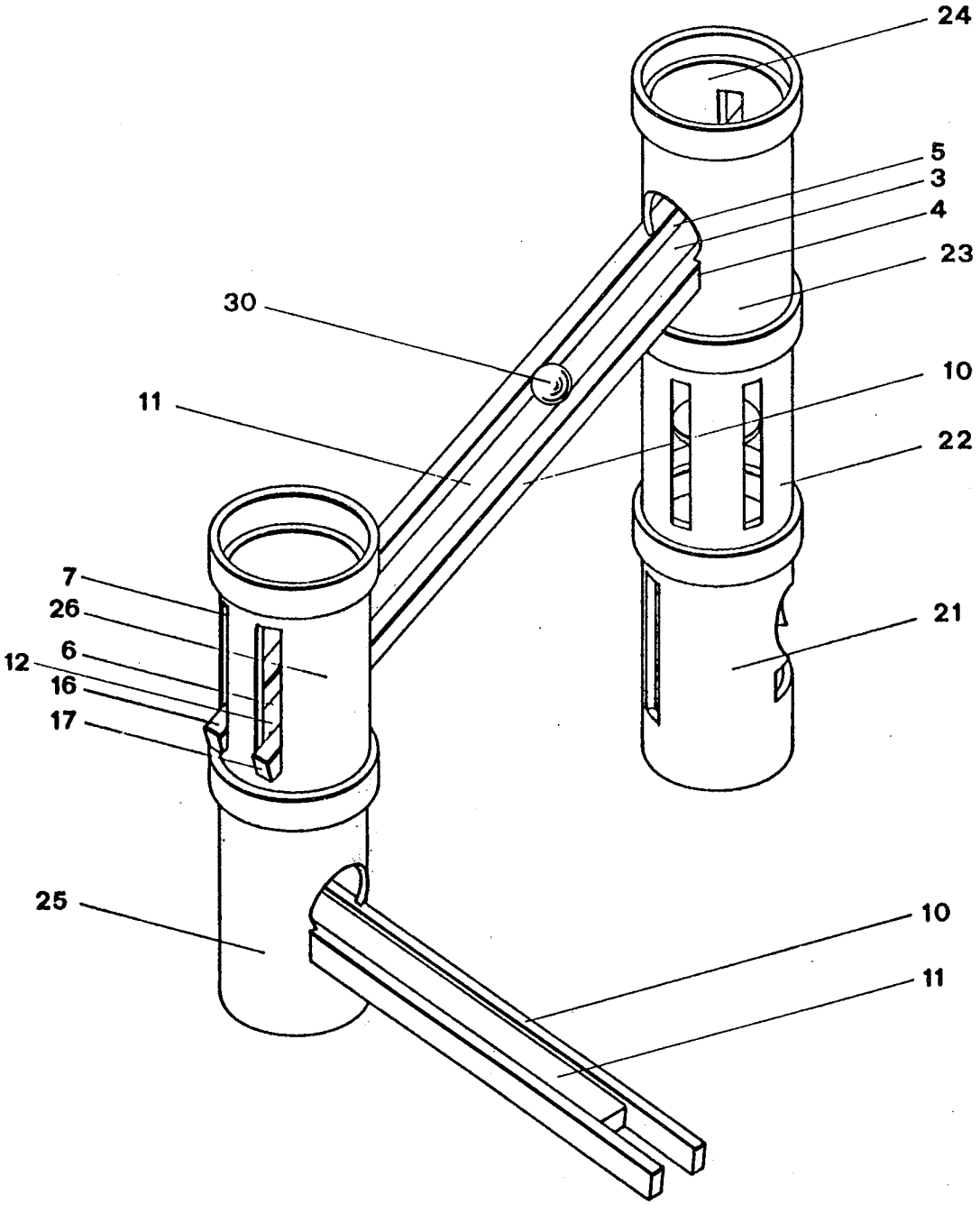
FIG. 7 is an isometric view of an apparatus assembled from a plurality of said first and second modular members as is taught by the preferred embodiment of the present invention.

FIG. 7 illustrates a somewhat schematic isometric view of one possible configuration of said first and second modular members. In the illustration shown, three identical first modular members 21, 22 and 23 all according to FIG. 1 are vertically stacked on top of one another. The rectangular portion 4 of the lateral opening 3 in modular member 23 is shown receiving the end of rod 10 that defines the shallower recess 13 (not shown in FIG. 7). The prongs corresponding to this opening (prongs 14 and 15 shown in FIG. 4 but not visible in FIG. 7) fit into slots 6 and 7 on the rear side of member 23. This configuration requires that the channel portion 11 of rod 10 blocks enough of the interior of hollow member 23 that a marble dropped into the top opening 24 of member 23 will fall onto groove 11 of rod 10, and, since rod 10 is inclined, said marble 30 will then roll along groove 11 towards its opposite end (the lower end) of rod 10. In the embodiment shown, the opposite end of rod 10, which bears the deeper recess 12 and prongs 16 and 17, is received by the rectangular portion of the lateral opening in another coupling member 26, which is identical to coupling members 21, 22 and 23. Coupling member 26 is mounted on top of yet another first modular support member 25. Prongs 16 and 17 of rod 10 engage slots 6 and 7 of modular member 26 leaving a sufficient portion of recess 12 open in the center of modular member 26 for marble 30 to fall through.

The heighth of the slots in the first supporting modular members sufficiently exceeds the width of the prongs on the second channel-shaped modular members to allow the second modular members to be elevated or depressed by approximately 20° with respect to the horizontal plane of the slots.

Modular member 25 receives the end of yet another second modular member bearing a shallow recess.

Thus marble 30, falls through the deeper recess of the upper rod, strikes the lesser recess of the lower rod and continues rolling along groove 11.

It will readily be apparent that any number of first supporting modular members may be vertically stacked and that these first supporting modular members may be rotationally aligned so their openings face in any desired direction. This permits an unlimited number of possible combinations of marble playing apparatus to be formed by children coupling said first and second modular members together.

The embodiment of the second channel-shaped modular member shown in FIG. 5 wherein the recesses at both ends of the second member are of equal depth it is utilized to stop the travel of the marble through the construction of modular members at any desired point.

The embodiment of the second modular member shown in FIG. 6, wherein an opening 31 is placed at one end of the channel-shaped member, may be utilized whenever it is desired to allow bore 31 to assume the function normally performed by the deeper recess 12 of allowing the marble to fall from the channel-shaped member vertically into the associated supporting first modular member.

The first supporting modular member may have any desired polygonal cross-section of sufficient size to pass a marble. In the case of a first modular supported member having a regular polygonal cross-section, the rotational freedom of the vertically stacked first supported modular members will be limited to a fixed number of azimuthal postions equal to the number of sides of the regular polygon in the cross section.

The present invention may be constructed of any suitable material, usually plastic, and may be made in any desired size to accomodate differing sizes of marbles.

I claim:

1. Apparatus for playing games with marbles comprising:

a plurality of first modular members, each said first modular member being a hollow cylindrical section having ends of unequal diameter such that the outer diameter of the smaller end is equal to the inner diameter of the larger end, whereby a plurality of modular members may be securely stacked, said first modular member being provided with an opening in the side of said section, said opening comprising an upper circular portion and a lower rectangular portion, said first modular member also having two vertical slots placed in its surface opposite said opening whereby the vertical plane of symmetry between the two slots passes through the vertical axis of the member and through the vertical plane of symmetry of said opening; and a plurality of channel-shaped second modular members, wherein the sides of said channel extend beyond the bottom of the channel at each end of the member to form two prongs at each end of said channel-shaped member, said prongs are adapted to securely fit into the slots of said first modular member when said channel-shaped second modular member is inserted into said rectangular portion of said lateral opening in said first modular member.

2. Apparatus for playing with marbles according to claim 1, wherein said first modular member has a regular polygonal cross-section.

3. Apparatus according to claim 1, including at least one marble, wherein the recesses formed by the prongs in said second channel-shaped modular member are of different depths, the difference being approximately the same as the diameter of said marble.

4. Apparatus for playing with marbles according to claim 1, wherein said recesses in said second channel-shaped modular member are of equal depth.

5. Apparatus according to claim 4, including at least one marble, wherein one end of said channel-shaped second modular member has an opening in the bottom of said channel approximately the size of said marble, the axis of said opening being essentially perpendicular to the longitudinal axis of said second modular member.

* * * * *